US008348221B2

(12) United States Patent
Seng et al.

(10) Patent No.: US 8,348,221 B2
(45) Date of Patent: Jan. 8, 2013

(54) FORMWORK SYSTEM FOR CONSTRUCTING A STRUCTURAL CONCRETE FLOOR WITH PROJECTING FLOOR BEAMS

(76) Inventors: Tang Hang Seng, Selangor (MY); Tang Hang Tow, Selangor (MY); Tang Hang Chyan, Selangor (MY)

( * ) Notice: Subject to any disclaimer, the term of this patent is extended or adjusted under 35 U.S.C. 154(b) by 602 days.

(21) Appl. No.: 12/527,392

(22) PCT Filed: Feb. 14, 2008

(86) PCT No.: PCT/MY2008/000011

§ 371 (c)(1),
(2), (4) Date: Aug. 14, 2009

(87) PCT Pub. No.: WO2008/100131

PCT Pub. Date: Aug. 21, 2008

(65) Prior Publication Data

US 2010/0025563 A1 Feb. 4, 2010

(30) Foreign Application Priority Data

Feb. 16, 2007 (MY) ..... PI 20070233

(51) Int. Cl.
*E04G 11/40* (2006.01)

(52) U.S. Cl. ..... 249/29; 249/27

(58) Field of Classification Search ..... 249/27, 249/28, 29, 30

See application file for complete search history.

(56) References Cited

U.S. PATENT DOCUMENTS

| | | | | | |
|---|---|---|---|---|---|
| 910,515 | A | * | 1/1909 | Drayer | 249/26 |
| 1,993,008 | A | * | 3/1935 | Jarboe | 249/28 |
| 2,038,296 | A | * | 4/1936 | Kendrick | 249/29 |
| 2,916,909 | A | * | 12/1959 | Miller | 52/323 |
| 3,678,693 | A | | 7/1972 | Markewitz et al. | |
| 3,744,945 | A | * | 7/1973 | Metrailer | 425/62 |
| 3,845,930 | A | * | 11/1974 | Metrailer | 249/29 |
| 3,940,105 | A | * | 2/1976 | Metrailer | 249/209 |
| 4,778,144 | A | * | 10/1988 | Gregory | 249/29 |
| 5,676,874 | A | * | 10/1997 | Lee | 249/19 |

FOREIGN PATENT DOCUMENTS

| | | | | |
|---|---|---|---|---|
| EP | 49880 | A1 | * | 4/1982 |
| EP | 121744 | A2 | * | 10/1984 |
| EP | 547356 | A1 | * | 6/1993 |
| GB | 2125475 | A | * | 3/1984 |
| JP | 03047371 | A | * | 2/1991 |
| JP | 03129065 | A | * | 6/1991 |

* cited by examiner

*Primary Examiner* — Michael Safavi
(74) *Attorney, Agent, or Firm* — Dicke, Billig & Czaja, PLLC; Michael A. Bondi

(57) ABSTRACT

A formwork system is provided for constructing a structural concrete floor, said formwork systems constitutes a main frame (100) forming a concrete slab structure, a plurality of side frames (110) each movably mounted at the edge of the main frame (100) for forming a concrete beam formwork structure, and a plurality of retainers mounted at the edge of the main frame (100) for supporting below the side frames (110) and jacking means for raising and lowering the formwork system. The side frame (110) being movable enables the formwork system to be effectively detached from a casted structural floor having concrete beams extended therefrom. The formwork system is also extricable on site after fabrication of the concrete ceiling slab floor and concrete beam.

19 Claims, 14 Drawing Sheets

FORMWORK SYSTEM FOR CONSTRUCTING A STRUCTURAL CONCRETE FLOOR WITH PROJECTING FLOOR BEAMS

CROSS REFERENCE TO RELATED APPLICATION

This Utility Patent Application claims the benefit of the filing date of Malaysian Application No. PI 20070233, filed Feb. 16, 2007, and International Application No. PCT/MY2008/000011, filed Feb. 14, 2008, both of which are herein incorporated by reference.

FIELD OF INVENTION

The present invention relates generally to the field of formwork for building construction, and more specifically to a proprietary formwork system which is designed to be struck in one piece for the casting and setting of concrete forming a floor at one level, and carried to a higher level above said floor for further casting and setting of concrete forming another floor.

BACKGROUND OF THE INVENTION

Formwork is a temporary structure that was erected for the purpose of allowing the wet concrete to be retained and shaped into desired shape and form. Its structure usually consists of sheathing, beams, walings, ties and any other supports that are necessary to ensure that the formwork structure is stable and rigid. It must also be safe for any worker working on or near the formwork.

In order to ensure the stability and rigidity of the formwork, it is important that sufficient longitudinal, transverse and diagonal bracings are provided. In addition, continuity of the structure, vertical supports and the structural conditions of the support members are also the key areas that must be looked at when designing and erecting formwork.

As for slab formwork, there is a proprietary formwork system called tableform which can limit or eliminate the need for site formwork erection. This can be done because tableform is a combination of soffit form and its supporting structure that are struck, moved and erected as one unit from one floor to another.

When considering the economic of construction, tableform is most likely used on high rise multi-stories structure with plain slab but also in low rise repetitive work. Construction details that most likely to hinder the use of tableforms are deep edge beams or other beams crossing in line of withdrawal of the tableform from the structure. Upstand beam or spandrel walls will further complicate matters and may need special adaption, such as folding legs.

The layout and size of the tableforms are usually determined by the shape of the soffit and the arrangement of columns, walls and access openings, together with the limitation of crane capacity of lifting gear. The leg loading and positioning will have to be considered in relation to the capacity of the supporting slab in the permanent structure, which may require back propping.

The design of tableform should follow the same principles as conventional soffit support system but the legs will be more widely spaced and therefore more heavily loaded. If adjustable steel props are used as part of the table framing, they are usually inverted and have a purpose-made bracing system.

Tableforms should normally be struck by first lowering the jack slightly, then releasing the form from the floor soffit to avoid shock load on the slab below. Only then should lifting devices be attached and the weight taken. Attempts to take the weight of the formwork while it is still in contact with the floor soffit can result in lifting devices becoming overstressed and possible damage to the crane, formwork, falsework and structure.

The conventional tableform of consisting a lot of soffit parts is causing it to be a rigid construction structure that copious diligence is required to have it installed and dismantled. It is also a limitation that said tableform containing a fixed top surface being not applicable to be further used for another time casting another ceiling floor.

SUMMARY OF INVENTION

The present invention was created to overcome or minimize difficulties which transpire in the assembly and handling of existing tableforms. In the present invention, the formwork system comprises of a main frame assembled to form a concrete slab formwork structure, and a plurality of side frames each movably mounted to the edge of the main frame to form a formwork structure which acts as the formwork for internal concrete floor beams projected from the concrete ceiling surface. For formwork system at the end of a floor span, the side frame is modified to provide a complete end side frame as an end floor concrete beam support because of the inability to erect another typical main frame with side frame attached at the end side as there is no floor for supporting below.

The formwork system has a system of beams and bracings that may be fixed to the props to hold them in a fixed relationship with respect to each other, which also may be in turn adapted to carry the secondary beams and sheathings to enable the concrete to be casted and allowed to set more effectively. The beams provided in the system may be adjustable and thus may be flexibly extended according to the required length. The invention could be used as a soffit formwork for any rectangular floor shape of any size by extending the adjustable beam members or by inserting additional main frames to the formwork system when the floor size exceeds the maximum extended length of the beam members. In addition to that, the main frame is capable of providing a clear working space underneath at the center of the formwork system. Thus, this condition will enable the striking and transporting of the formwork system with the minimum of effort.

The formwork system is supported by attaching the main props to a series of base support structures which sit on the floor below, and whereby telescopic jack, trollies and other ways for moving the formwork support system may be introduced beneath them.

It is an object of the invention to provide a formwork system that can be easily detached from the concrete ceiling floor having concrete beams extended therefrom. Side frames are provided at the edges of the main frame with pivotal connection. After the concrete ceiling floor with the concrete beams had harden, the side frames can be disengaged from the main frame. Once disengaged, the side frames can be slightly tilted, allowing the side frames to be detached from the casted concrete beams. The side frames can be then unobtrusively removed when the formwork system is being lowered down.

It is yet another object of the invention to provide a formwork system that is also capable of casting the concrete beams if they are extended from the concrete ceiling floor. At the edges of the main frame, the side frames which are provided, constitute sheathings for casting of concrete beams at the sides of the main frame.

It is also an object of the invention to provide a formwork system that has an extensible surface of formwork. The beam is provided with telescopically received interconnections to enable the whole beam being able to extend adjustably according to the required length.

It is final object of the invention to provide a formwork system that can be repetitively used. The extensible surface of the formwork allows various sizes of concrete ceiling floor to be flexibly casted. The formwork system is also adapted to be lowered by appropriate jacking means and optionally having a plurality of wheels detachably mounted at the bottom of the props for transportation functions.

BRIEF DESCRIPTION OF DRAWING

For the purpose of facilitating an understanding of the invention, there is illustrated in the accompanying drawings the preferred embodiments from an inspection of which when considered in connection with the following description, the invention, its construction and operation and many of its advantages would be readily understood and appreciated.

DETAIL DESCRIPTION OF INVENTION

The present invention relates to a formwork system which is not only capable of casting typical concrete slab ceiling floor but also concrete ceiling floor which might constitutes concrete beams extended from the surface of the ceiling that further add supports to a building. It is therefore conceived a formwork system which is comprised of a main frame (100) to form a slab formwork under a concrete structural floor and at the sides of the formwork structure, pivotally connected side frames (110). While for the end of a spanned floor, the side frames (110) may further be assisted by end side frames (130), enabling a complete end concrete beam formwork to be erected.

Figure 1:
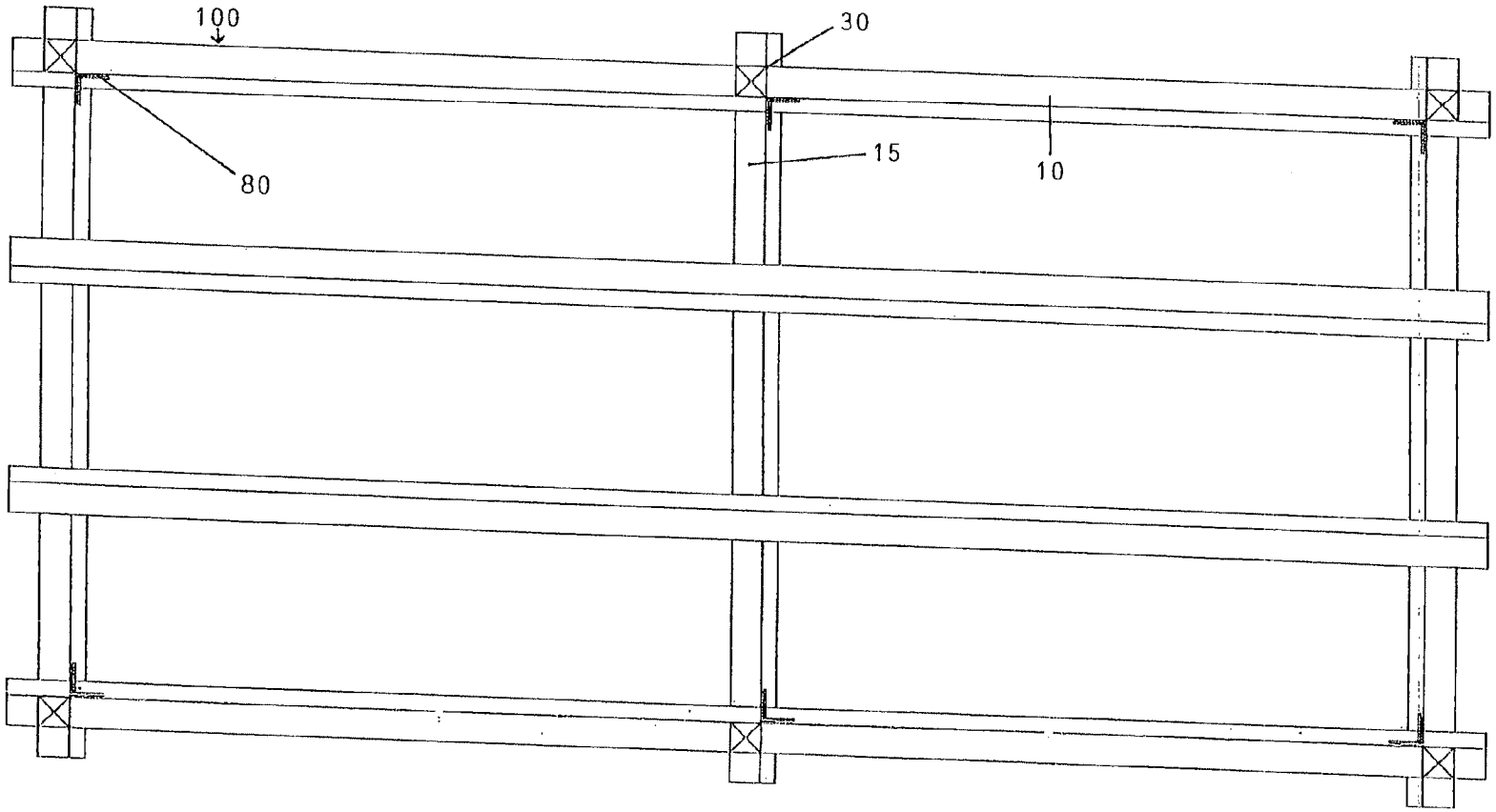
FIG. 1 is the top level layout of the present formwork system before extension.

Referring now to the drawings, and particularly to the FIG. 1, there is disclosed in this view the formwork system as viewed from the top. The main frame (100) is comprised of a number of main props (30), a number of upper secondary beams (10) and a number of upper primary beams (15) which spans transversely below the upper secondary beams (10). The upper primary and secondary beams (10 & 15) are secured to the main props (30) by means of securing means which may be threaded fasteners, and are further supported by means of supporting brackets (80).

Figure 2:
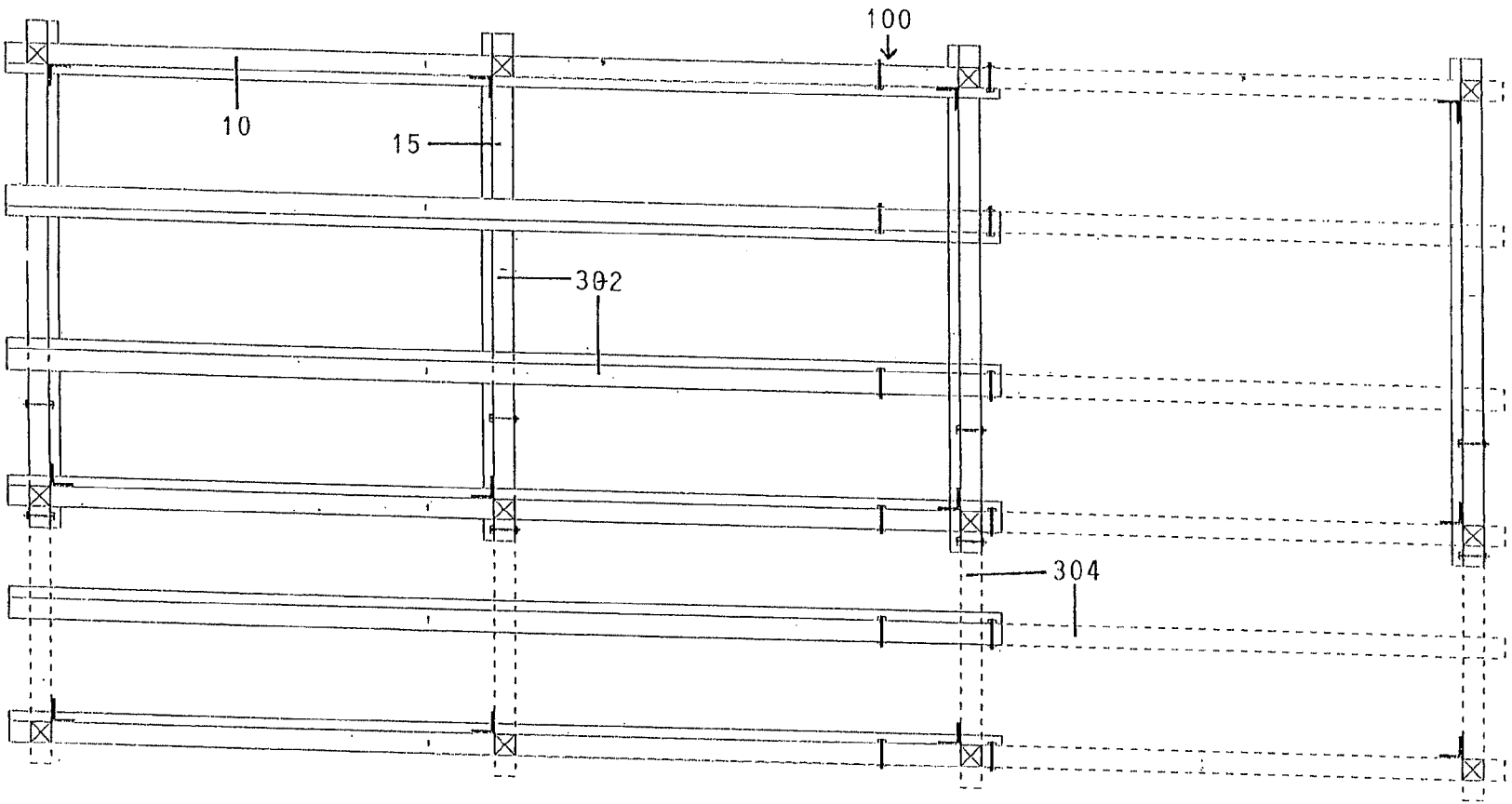
FIG. 2 is the top level layout of the present formwork system in extended form.

Referring to FIG. 2, the main frame is shown being extended to a longer width and length. Both upper primary and secondary beams (10 & 15) may constitute outer portions (302) each having relatively large cross sectional area and inner portions (304) each having relatively small cross sectional area to be telescopically received into said outer portions (302) for selective length adjustment. The outer portion (302) is preferably a L-shaped beam whereas the inner portion (304) may be a steel or timber beam which can slide along the length of the outer portion (302). A desired length of said beams (10 & 15) may be extended and selected by means of securing of fasteners through bores which are concocted through said inner and outer portions (304 & 9302). A precasted concrete ceiling floor which may have a predetermined surface size can be accommodatingly casted to with the presence of the extensible beams (10 & 15) provided at the main frame (100).

Figure 3:
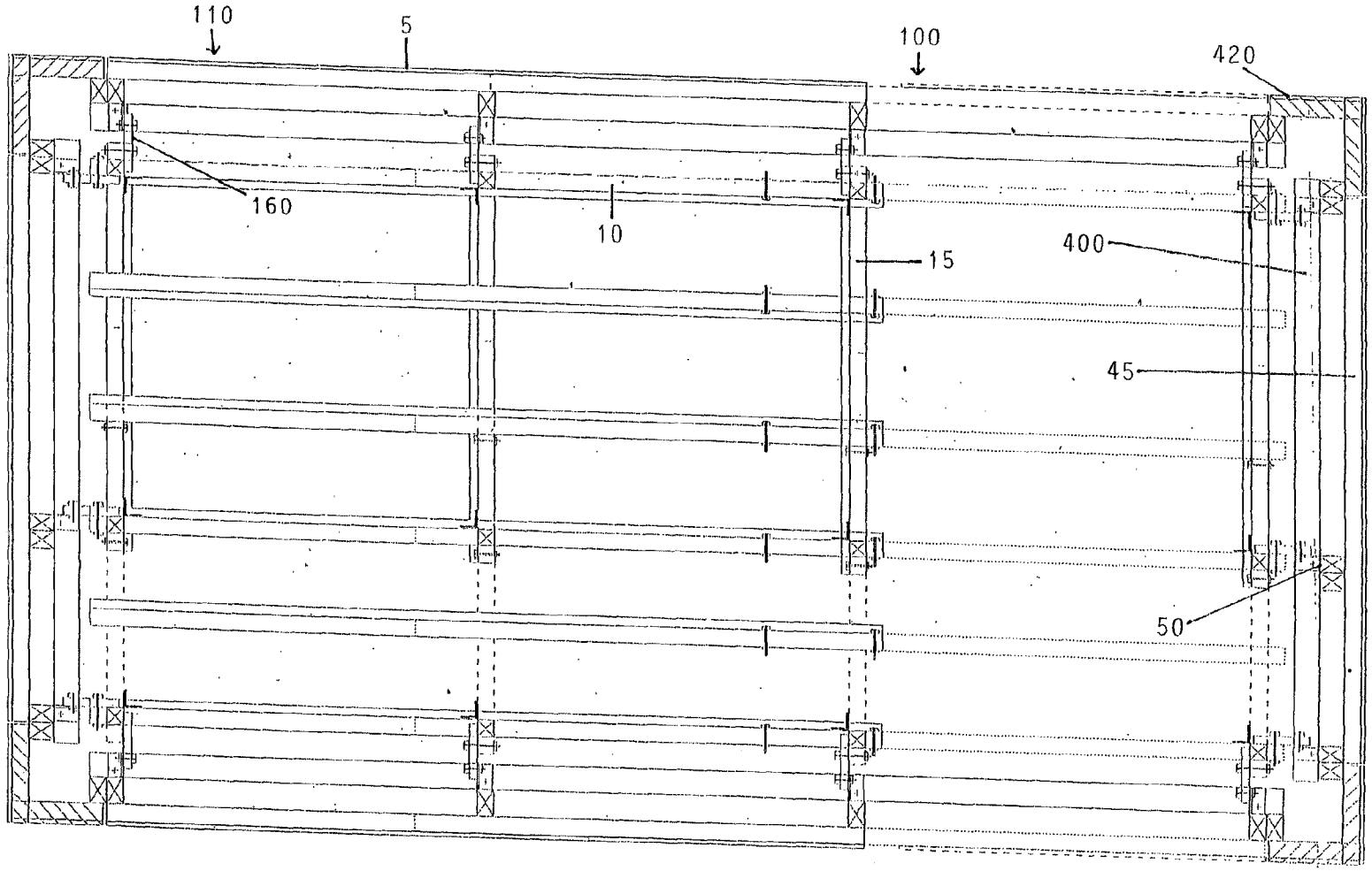
FIG. 3 is the top level layout of the present formwork system.

In FIG. 3, at the perimeter of the formwork system there are side frames (110) by means of mounting brackets (160) secured to the main frame (100). As shown, the side frame (110) is constituted of sheathings (5) provided at the outer side as a side formwork for casting the concrete beams. The side frame is assembled of side beams (45) spanning across the inner side of the sheathings (5) and also side props (50) vertically extending across the side beams (45). The mounting bracket (160) at one end is attached to the side prop (50) and the other end is attached to the upper secondary beam (10) at the main frame (100). The side frame (110) also further incorporated an inner beam (400) which transversely extends at the inner side of the side props (50). The inner beam (400) extends below the mounting brackets (160) to further support the connection of the mounting bracket (160) to the side frame (110). The side and inner beams (45 & 400) may be extended may each compose outer portion having relatively large cross sectional area and an inner portion having small cross sectional area to be telescopically received into the outer portion for selective length adjustment suiting the required length of the concrete beam prior to casting. A corner beam formworks (420) may be optionally installed at each corner of the main frame (100) depending on the preferred embodiment of the present invention.

Figure 4:
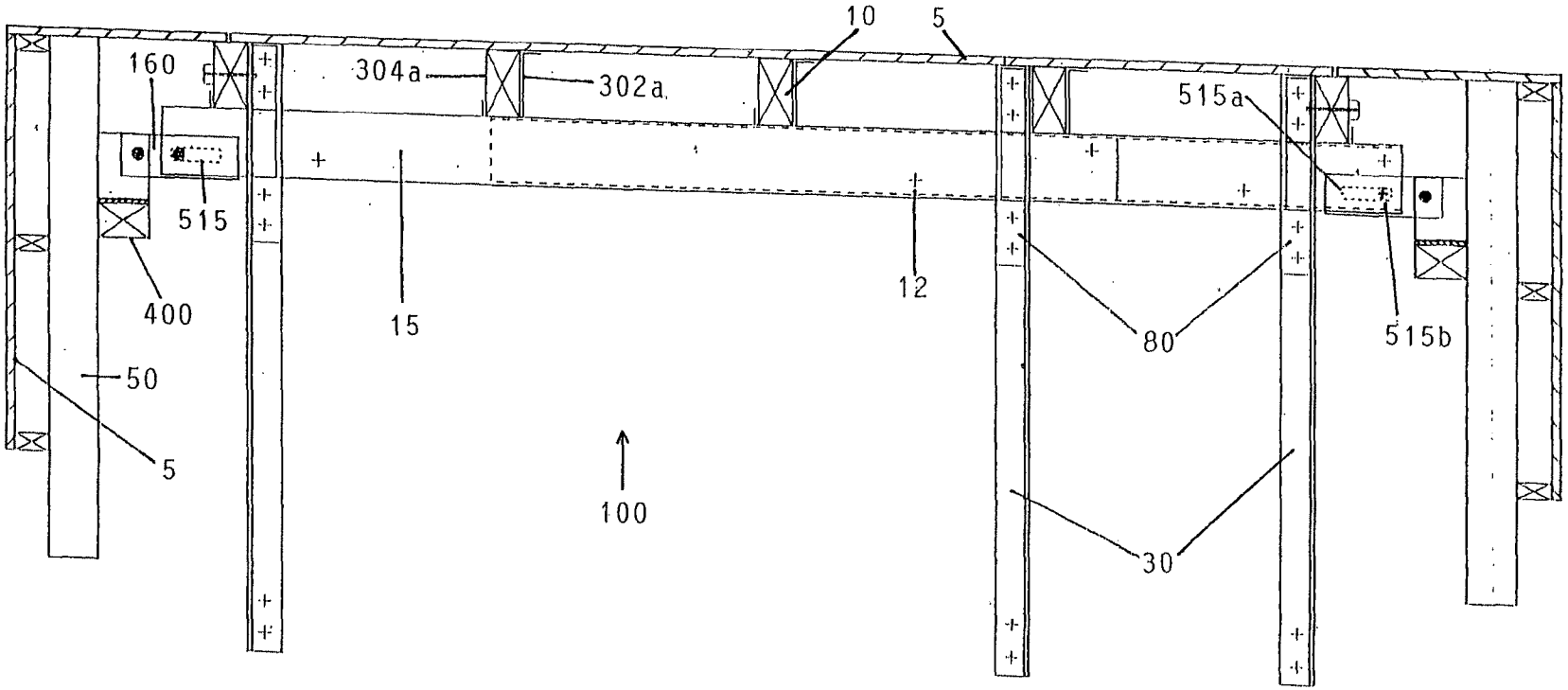
FIG. 4 is the elevation of the present formwork system along the upper primary beam showing the main frame and side frames in attached position.

FIG. 4 further illustrates the formwork system as seen along the upper primary beam (15). Main props (30) are distributively installed at the main frame (100). Sheathings (5) which act as the skin of the formwork is mounted on top of the upper secondary beams (10). The upper secondary beams (10), as shown arranged in parallel relationship, are mounted on the upper primary beams (15). Both upper primary and secondary beams (10 & 15) are attached to the main props (30) and their attachment is further supported to the main props (30) by means of supporting brackets (80). The beams (10 & 15) are mounted to the main props (30) by having securing means preferably threaded fasteners secured through bores formed at the beams (10 & 15) and the main props (30). The supporting bracket (80) is also formed with bores each to be secured with fastener which also extends to another bore formed at the corresponding beams. As illustrated in FIGS. 3 and 4, as aforementioned, the upper secondary beam (10) is extensible and the extension is enabled by preferably utilizing L-shaped metal beam (302*a*) having relatively large cross sectional area and a timber or a metal beams (304*a*) having relatively small cross sectional area to be telescopically received into the L-shaped metal beams (302*a*) for selective length adjustment. The upper primary beams (15) are formed in the similar manner as well, said beams (10 & 15) contain bores for fasteners to be extended through for selective adjustment of length.

Still referring to the FIG. 4, the mounting brackets (160) are illustrated with one end pivotally attached to the side props (50) of the pivotable side frame (110) whereas the other end is pivotally attached to the upper primary beam (15). The first end is attached to the side prop (50) by means of a fastener extending through an aperture formed at said end and also the aperture concocted at the side prop (50) and the mounting bracket (160). The second end is also pivotally mounted to the upper primary beam (15) with a fastener extending through apertures formed at said beam (15) and the mounting bracket (160). The second aperture of the mounting bracket (160) is elongated with an inner end (515*a*) and an outer end (515*b*) referring to FIG. 4. The second aperture (515) of said second end of the mounting bracket is elongated as to facilitate the side frame (110) to be detached from the concrete beam during the descending of the formwork system. Underneath the mounting bracket (160), an inner beam (400) is installed to the side prop (50) to support the mounting bracket (160). Sheathings (5) of the side frame (110) are shown mounted to the side beams (45) which are fixed transversely to the side prop (50).

Figure 5:
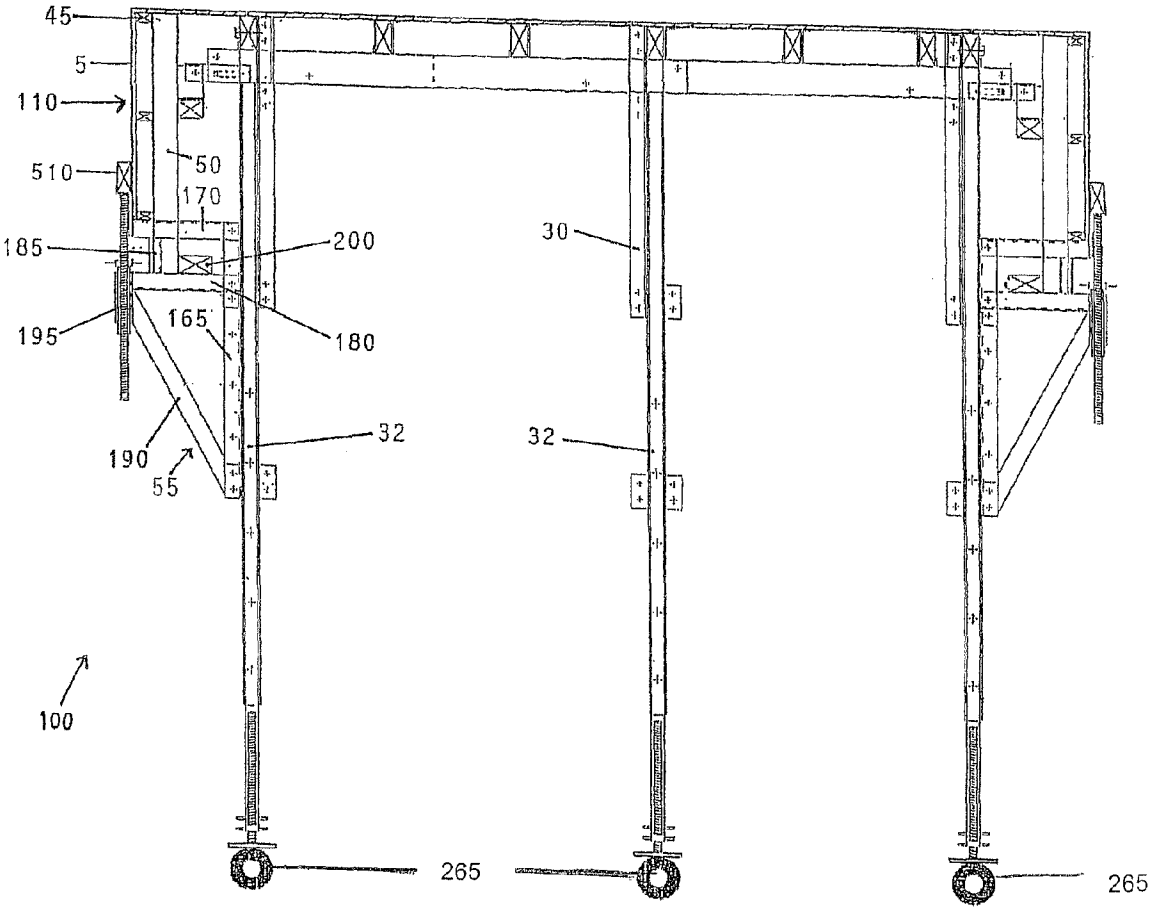
FIG. 5 is the elevation of the present formwork system along the upper primary beam showing wheels being attached at the bottom.
Figure 8:
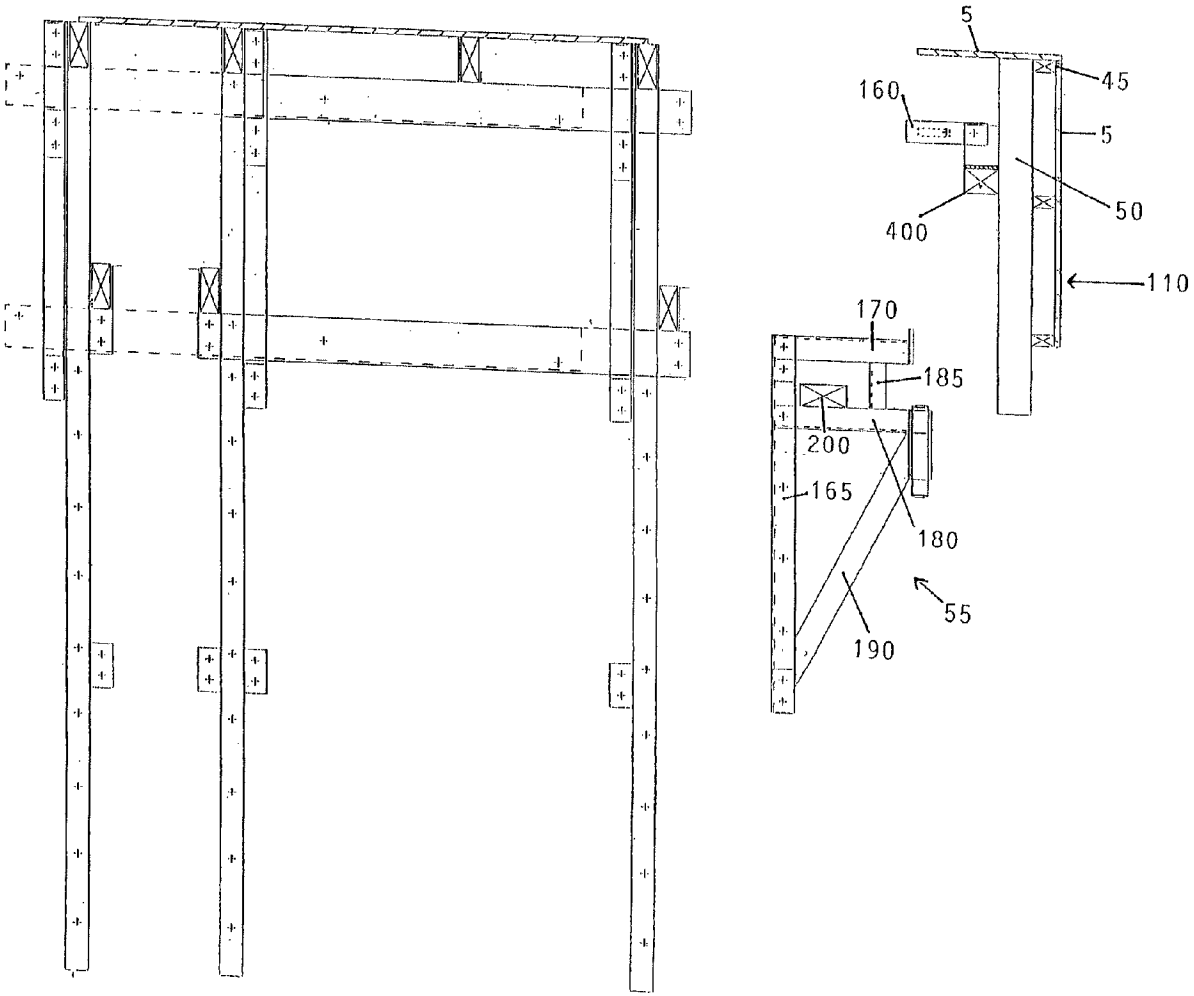
FIG. 8 is the elevation of the present formwork system along the upper primary beam showing the side frame and the cantilever bracket in detached position.

In FIG. 5, legs (32) are provided to further extend the height of the formwork system. The leg (32) is mounted to the main props (30) of the main frame (100). At the bottom of the leg (32) is shown a wheel (265) which may be mounted for facilitating transportation once the formwork system is not used in operation. A jacking means (not shown) may also be provided at each of the leg (32) for adjusting the height of the main frame (100) when needed. As shown in FIG. 8, the formwork system also comprises of retainers which support below the side frames (110). The retainers may be formed as cantilever brackets (55) as shown in FIG. 5 and FIG. 8. The cantilever bracket (55) is constituted of a side truss (165) detachably mounted to the leg (32) and the positioning of the side frame (110) may be adjustably fixed depending to the height of the concrete beam. An upper horizontal member (170) and a lower horizontal member (180) are attached to the side truss (165) as shown in FIG. 5. A vertical bracing (185) is extended between the upper horizontal member (170) and the lower horizontal member (180). The cantilever bracket (55) also comprises a side inclined bracing (190) with one end attached to the lower horizontal member (180) and the other end attached to the side truss (165).

On top of the lower horizontal member (180), a horizontal beam (200) is shown transversely mounted. When the cantilever bracket (55) is installed in position to retain said side frame (110), the horizontal beam (200) retains the side prop (50) of the side frame (110) from moving inwards. The horizontal beam (200) is also built to have outer portions having relatively large cross sectional area and inner portions having relatively small cross sectional area each to be telescopically received into the outer portion. Therefore, the length of the horizontal beam (200) can be adjusted to the required length when the main frame (100) is extended.

When a concrete beam is needed to be casted, the side frame (110) which is tiltable would be held rigidly by the cantilever brackets (55) besides being supported by the cantilever brackets (55). The bottom portion of the side beam (45*a*) would lay on the upper horizontal member (170) as shown in FIG. 5. To form a complete concrete beam, the bottom portion of the concrete beam would be casted by a sheathing (5) disposed above a retaining beam (510) supported on a leveling jack (195). The leveling jack (195) can adjust the height of the bottom sheathing (5) as the concrete beam to be casted may adopt a predetermined height.

Figure 6:
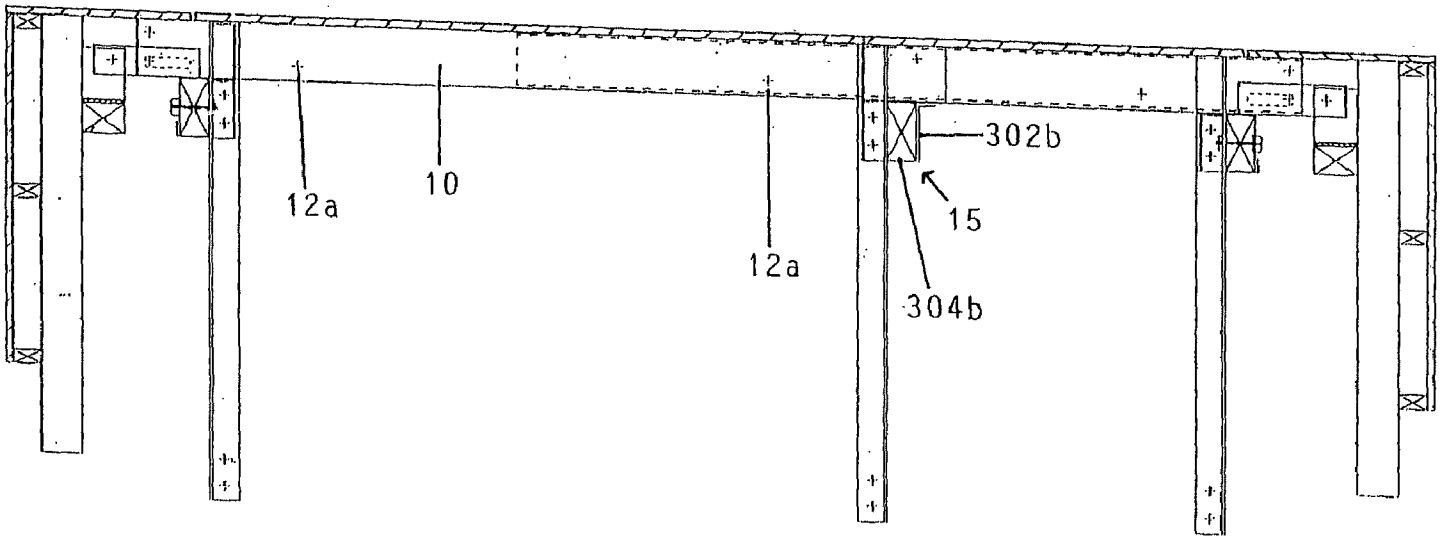
FIG. 6 is the elevation of the present formwork system along the upper secondary beam.

FIG. 6 further illustrates that the upper primary beam (15) is preferably composed of L-shaped metal beams (302*b*) having relatively large cross sectional area and a timber or a metal beams (304*b*) having relatively small cross sectional area to be telescopically received into the L-shaped metal beams (302*b*) for selective length adjustment. Above the upper primary beams (15), the upper secondary beams (10) contain bores (12*a*) for fasteners to be extended through for selective length adjustment.

Figure 7:
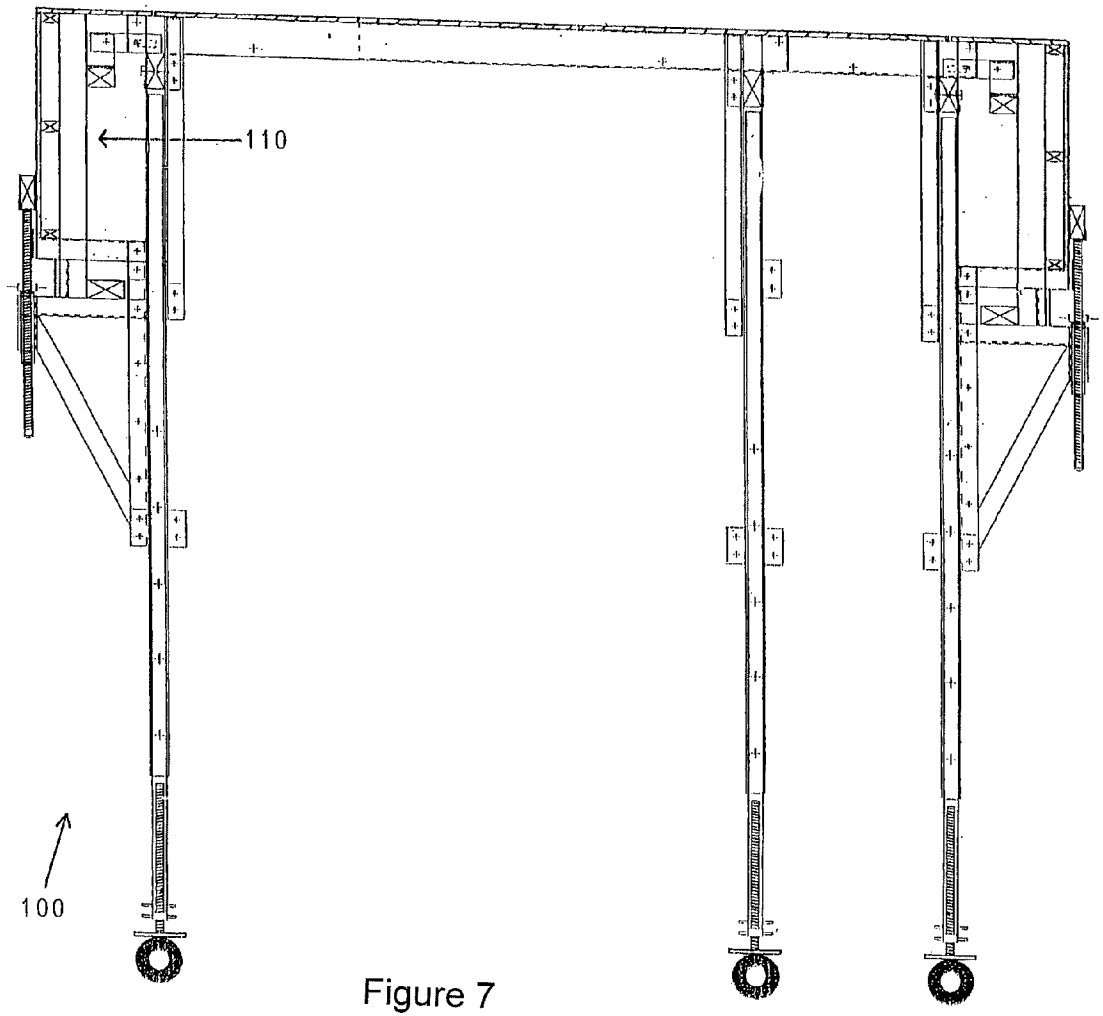
FIG. 7 is the elevation of the present formwork system along the upper primary beam showing wheels being attached at the bottom.

FIG. 7 shows the formwork system as seen along the upper secondary beam (10). At both sides of the main frame (100), the side frames (110) are apparently attached to the main frame (100) in a similar manner as aforementioned.

Figure 9:
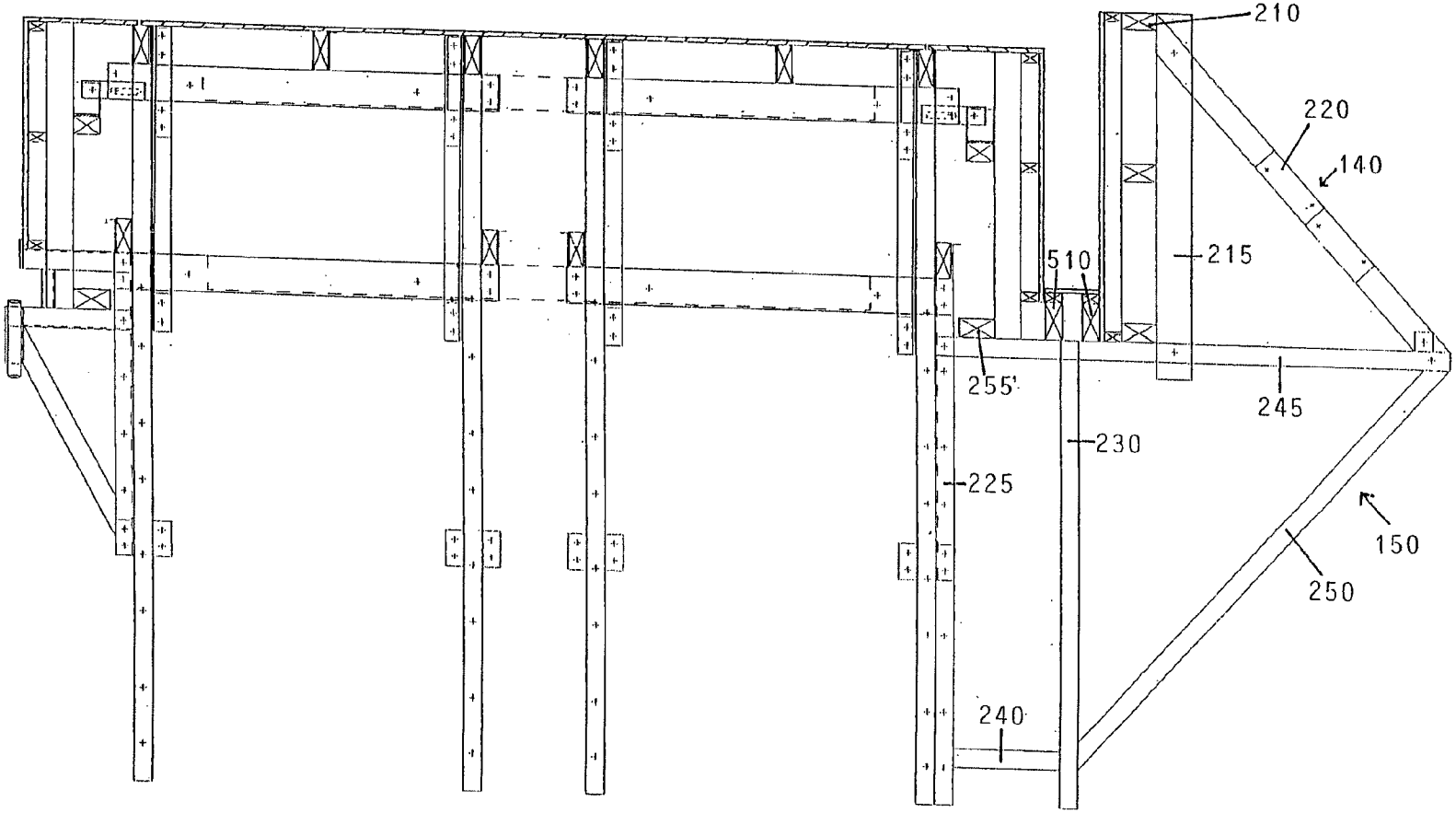
FIG. 9 is the elevation of the present formwork system along the upper primary beam showing the main frame and the outer side frame
Figure 10:
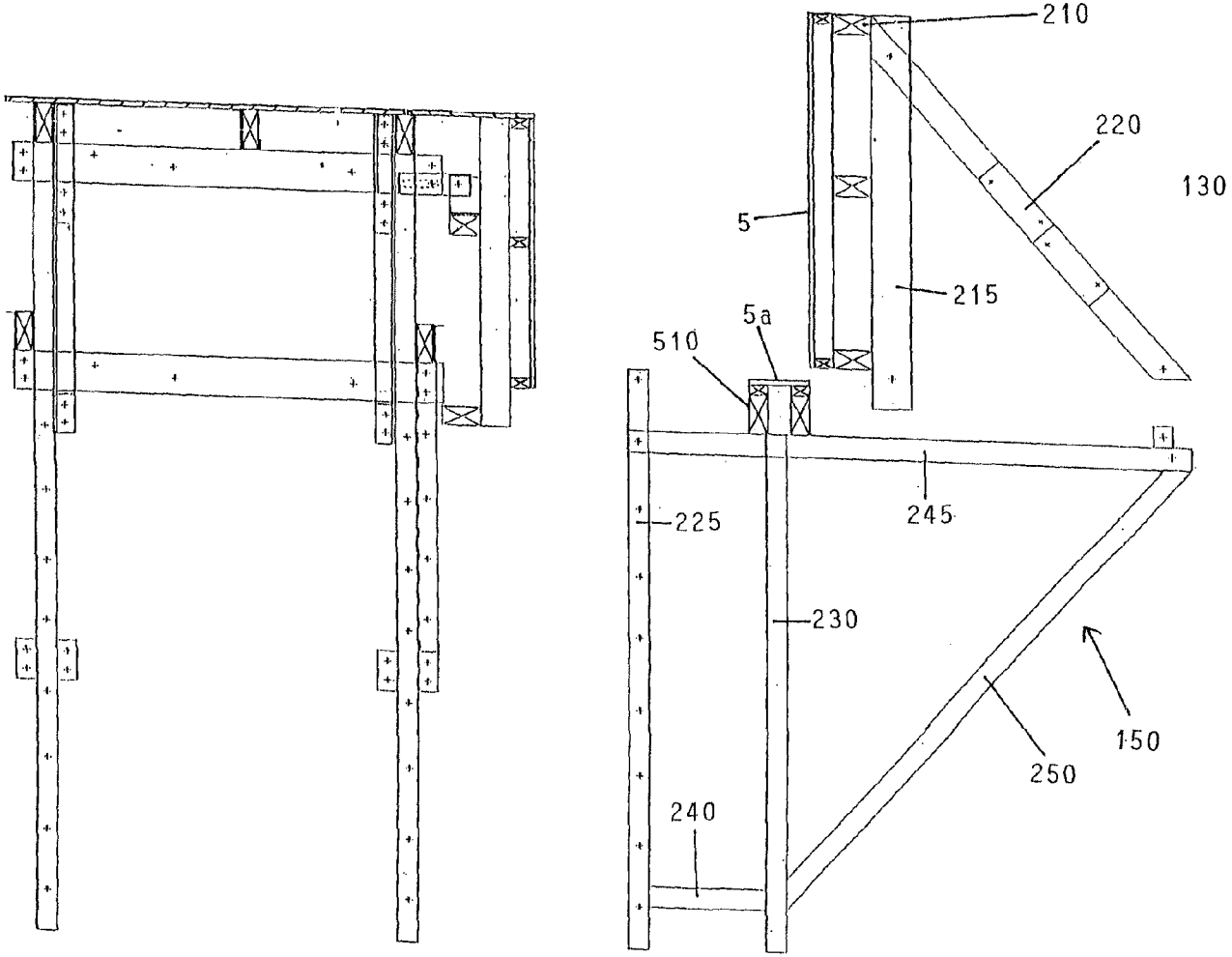
FIG. 10 is the elevation of the present formwork system along the upper primary beam showing the main frame and the outer side frame in detached position.

Referring to FIGS. 9 and 10, at the end of a ceiling concrete floor to be casted, an outer formwork section is erected comprising an end side frame (140) and a cantilever portion (150). The outer side frame (130) is shown constituting sheathings (5), outer side beams (210) spanning across the inner side of the sheathings (5), outer side props (215) to retain the outer side beams (210) and outer inclined bracings (220) at the upper end mounted to the outer side props (215) and at the lower end fixed to a cantilever portion (150).

The cantilever portion (150) is comprised of inner side trusses (225) each adjustably mounted to the leg of the main prop (32), outer side trusses (230) each may be having a base jack (not shown) engaged at the bottom end thereof and a horizontal bracing (240) at the lower portion connected to the inner side truss (225), horizontal shafts (245) each propped at the top ends of the inner side truss (225) and the outer side truss (230), diagonal beams (250) each attached to the lower portion of the outer side truss (230) and the outer end of the of the horizontal shaft (245), and retaining beams (510) mounted transversely on the horizontal shafts (245) and positioned between the side frame (110) and the end side frame (140), and longitudinal sheathing mounted on the retaining beams. The outer inclined bracing (220) of the outer side frame (130) is coupled at its lower end to the outer ends of the horizontal shafts (245). The longitudinal beam (255) mounted to the side frame (110), The longitudinal beam (255) may have outer portions having relatively large cross sectional area and inner portions having relatively small cross sectional area each to be telescopically received into the outer portion for selective length adjustment. Any form of fasteners may be used to be extended through fastener receiving holes formed at the outer formwork section thereof to connect all the members of the outer formwork section together.

For a typical end side frame (140), the sheathing (5) act as a complete formwork for the end concrete beam construction because of the inconvenience to erect another typical main frame (100) with a side frame (110) at the outer side which does not have a floor below for supporting. Referring to FIG.

10, it shows the end side frame (130) and the cantilever portion in a detached position.

Figure 11:
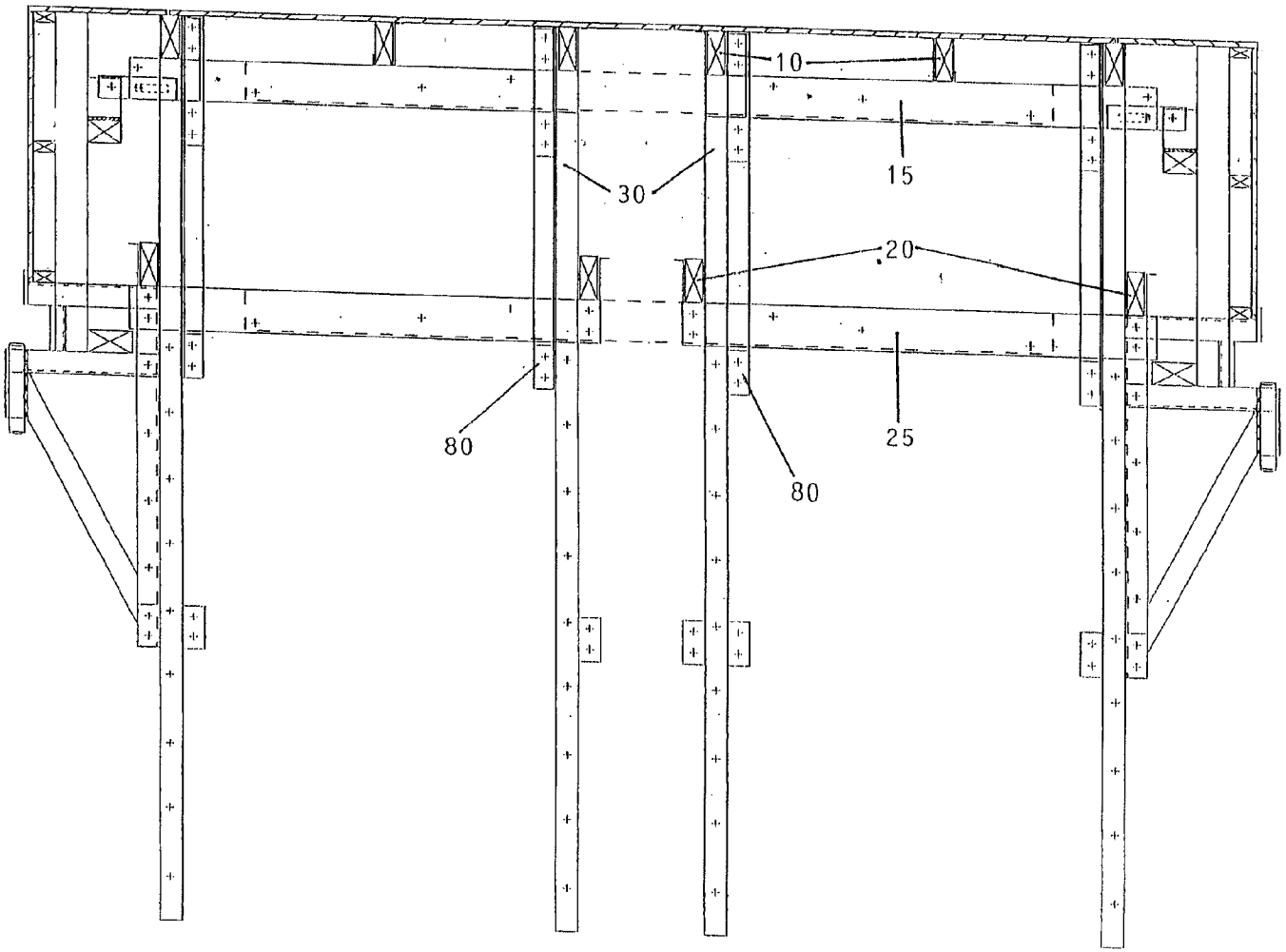
FIG. 11 is the elevation of the present formwork system along the upper primary beam showing the lower primary and secondary beams at lower deck.

As illustrated in FIG. 11, according to another embodiment of the present invention, the main frame (100) as viewed along the upper primary beam (15), further comprises lower secondary beams (20) mounted to the main props (30) at a lower deck in spaced-apart parallel manner, lower primary beams (25) also mounted to the main props (30) spanning across the main frame (100) under the lower secondary beams (20), supporting brackets (80) which are mounted to the main props (30) further supportively engage the lower primary and secondary beams (20 & 25), vertical bracings (not shown) at the top end may be mounted to the upper primary beam (15) and at the bottom end attached to the lower primary beam (25), and inclined bracings (not shown) each at the upper end connected to the lower primary beam (25) and the lower end connected to the main prop (30).

Figure 12:
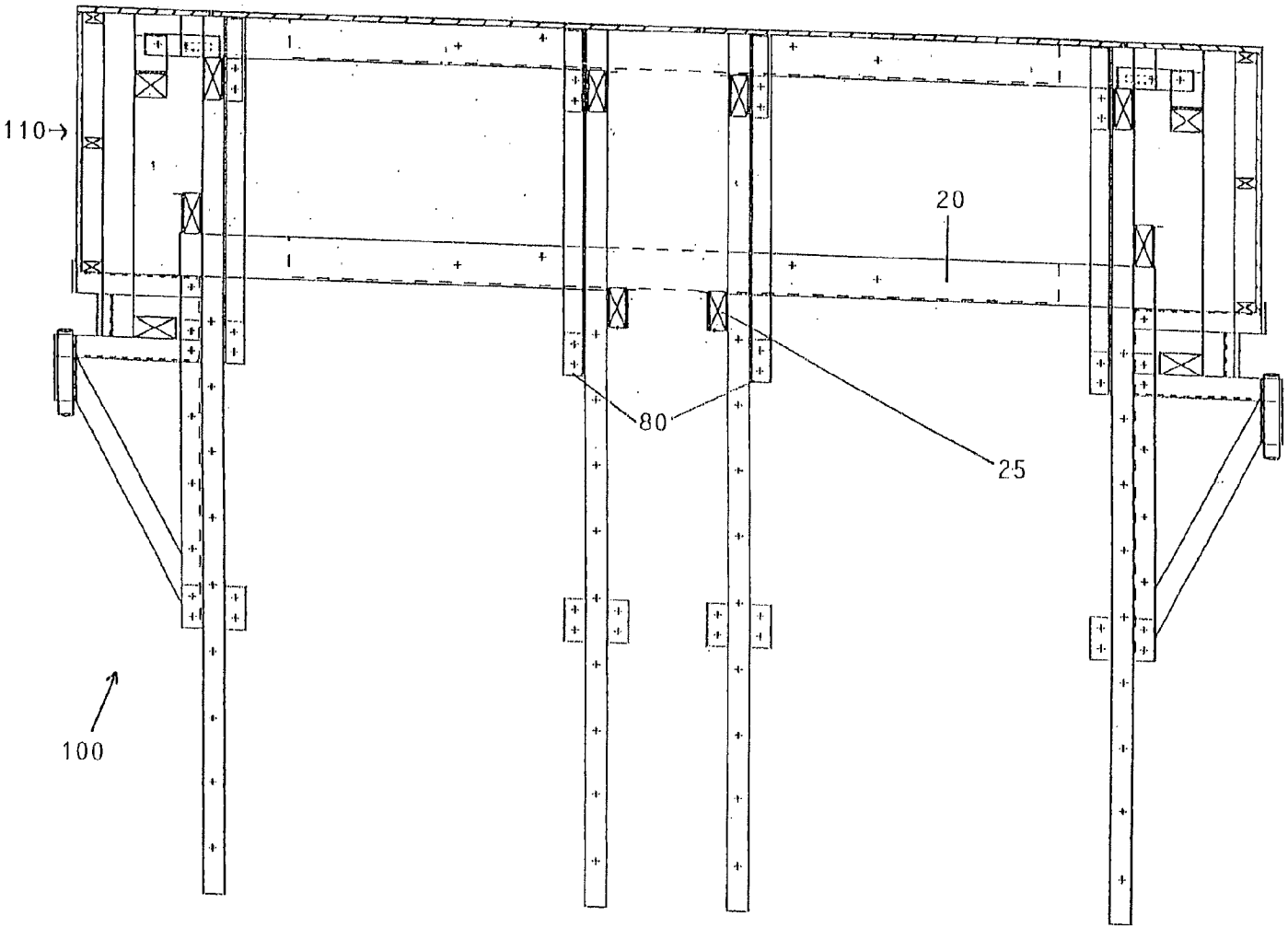
FIG. 12 is the elevation of the present formwork system along the upper secondary beam showing the lower primary and secondary beams at lower deck.

Referring to FIG. 12, the main frame (100) is shown as seen from another perspective view along the upper secondary beam (10), the lower secondary beam (20) spans across the main frame (100) and the lower primary beams (25) each extend transversely under the lower secondary beams (20). The supporting brackets (80) are also shown installed to further propping upper and lower primary beams (20 & 25), and another set of inclined bracings (not shown), each at the upper end connected to the lower secondary beam (20) and at the lower end connected to the main prop (30). The lower primary and secondary beams (20 & 25) are also capable of being extended similarly to the upper primary and secondary beams (10 & 15). The lower primary and secondary beams (20 & 25) each constitute outer portions having relatively large cross sectional area and inner portions having relatively small cross sectional area each to be telescopically received in the outer portions. The length of said beams (20 & 25) can be selectively adjusted according to the required size of the main frame (100) surface by means of fasteners extending through bores formed at appropriate positions on said beams (20 & 25). The outer portion may be shaped as a L-shaped beam and the inner portion may be a timber or a metal beam slidably inserted to said L-shaped beam. In certain applications of the invention, it may be considered desirable to provide additional beam or frame to be further struck at the main frame (100) as the case may be that the formwork system requires to span a larger surface area or retain a greater weight concrete.

Referring again to FIG. 4 and FIG. 6, the second end of the mounting brackets (160) consists an elongated aperture (515) formed for a fastener to extend therethrough. This pivotally attaches said second end to the upper primary beam (15) of the main frame (100). In the practice of the invention, the height of the concrete beam to be casted would be determined. A side frame (110) which has the same height would be installed to the main frame (100). The cantilever brackets (55) are assembled to the main frame (100) at appropriate height so that at the bottom of the side beam (50) and side beam (45*a*) could retain the side frame (110) in an upright disposition. The leveling jack (195) which retains the sheathing (5) of the bottom of said concrete beam would also be adjusted its position in accordance to the height of said concrete beam. Once the concrete beam has harden, said leveling jack (195) together with the sheathings (5) would be loosened first and the sheathing (5) of the bottom of the concrete beam would also be descended.

Figure 13A:
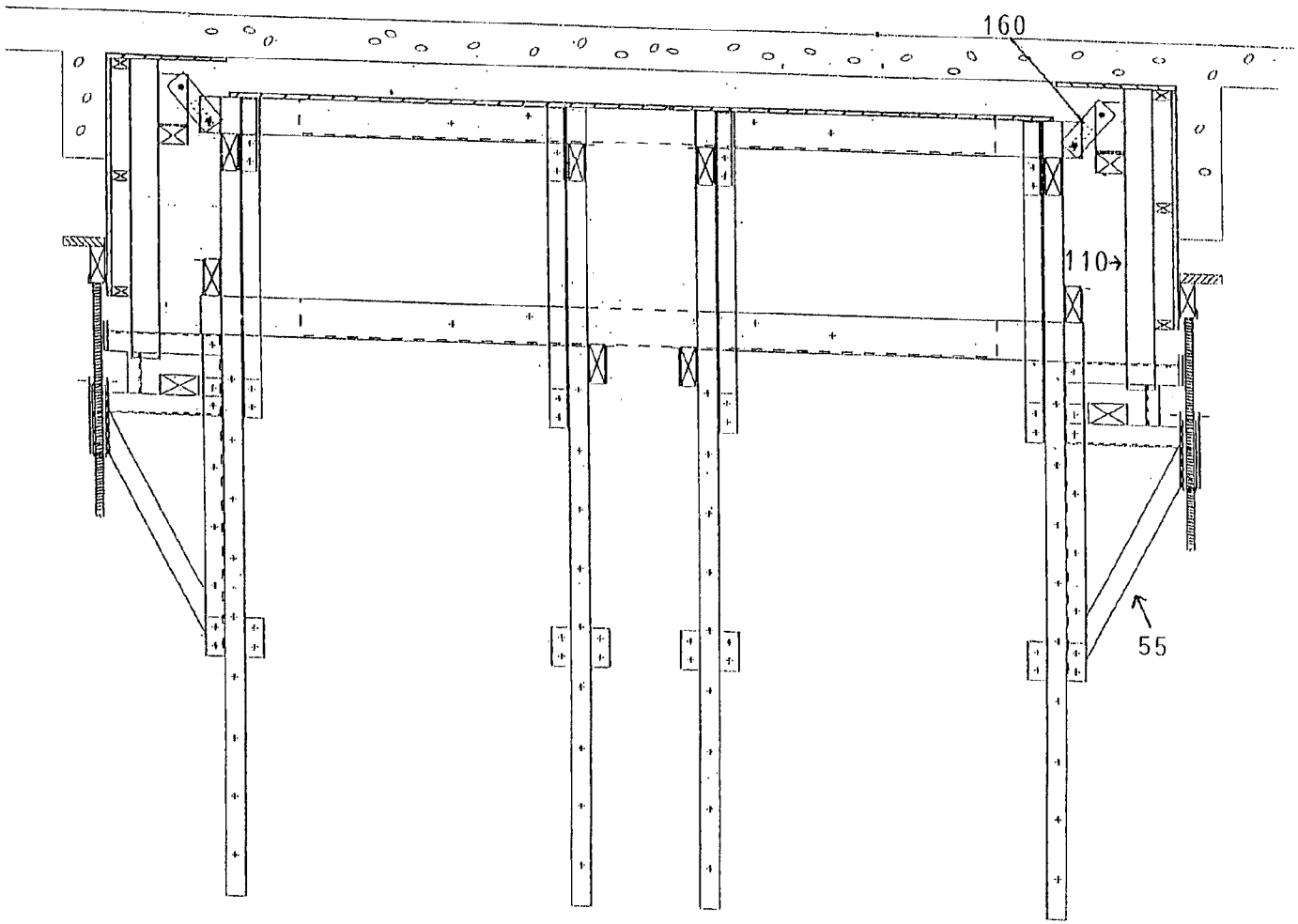
FIG. 13*a* is the elevation of the present formwork system showing the present formwork system being lowered down.
Figure 13B:
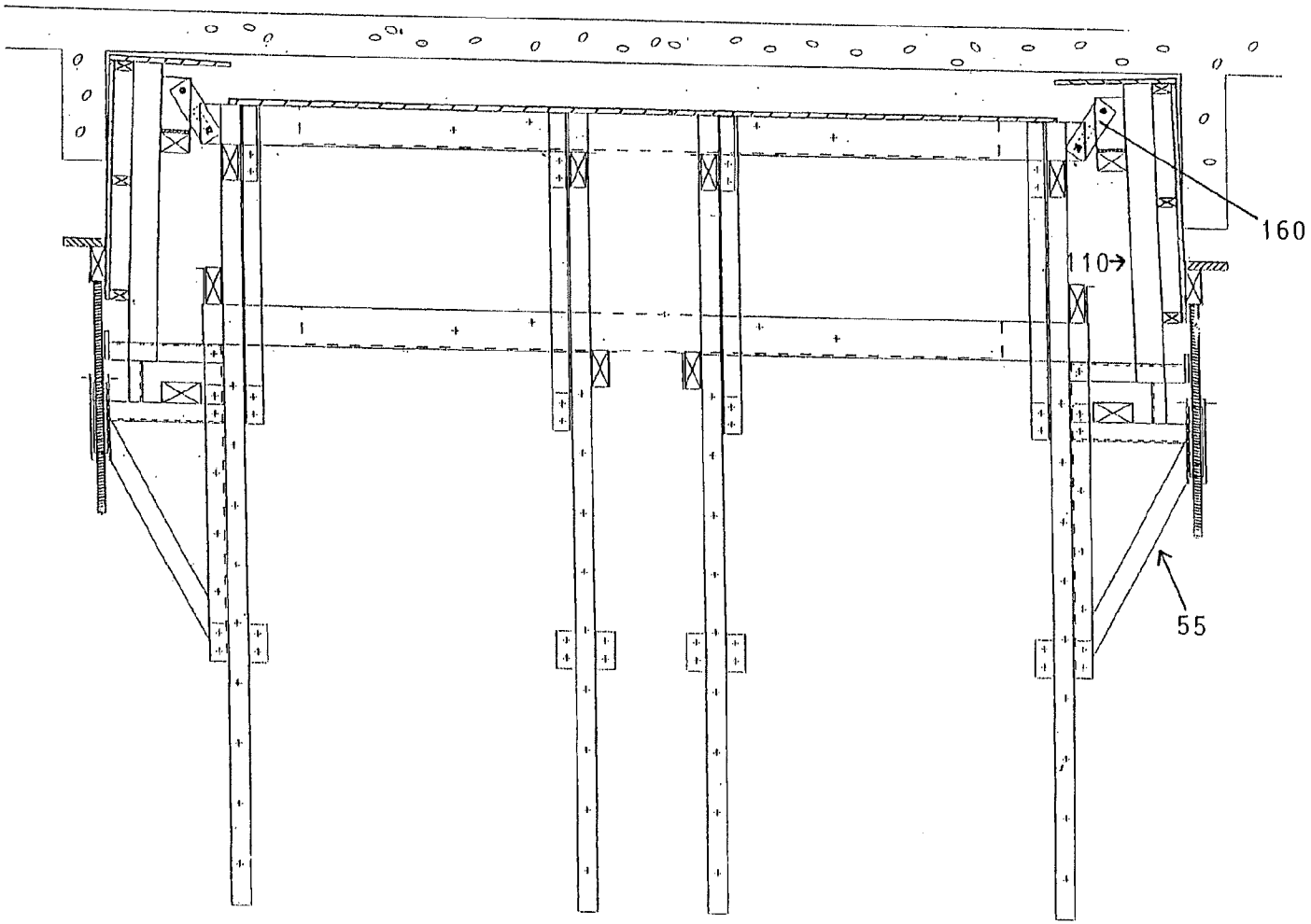
FIG. 13*b* is the elevation of the present formwork system showing the present formwork system subjected to a further descent.

Referring to the FIGS. 13*a* and 13*b*, to disentangle the whole formwork system from the harden concrete floor structure, the main frame (100) would be lowered down and the cantilever bracket (55) would descend together with the main frame (100). The lowered cantilever bracket (55) of the main frame (100) may detach itself from the side frame (110) and the side frame (110) would be free from the cantilever bracket (55) retainment. This is followed by the pulling which transpires at the mounting bracket (160). The action of pulling would tilt the mounting bracket (160) and subsequently with continuous lowering the side frame (110) would be pulled and consequently detached from the harden concrete beam, as view from FIG. 13*b*. The lowering of the main frame (100) at this stage would be continued. After the side frames (110) are detached from the concrete beam, it would be ensued by the descent of the corner beam formworks (420) which also utilizes the similar connection as the side frame (110).

The side frame (110) and the corner beam formwork (420) are purposely adapted to be inwardly tiltable. The corner beam formwork (420) upon subjected to a descent would be detached from concrete beam. It facilitates the lowering of the formwork system with the side frames (110), and the optional corner beam formworks (420) would not be obstructed by the concrete beam during the lowering of the formwork system. The side frame (110) may be formed distanced from the main frame (100) particularly at top portion so that when the side frame (110) is tilted during the lowering, consequently the side frame (110) could maneuverably detach from the concrete beam. As best illustrated in FIG. 13*a*, the formwork system is lowered down, the top end portion of the main frame (100) particularly the sheathing (5) distances from the top portion of the side frame (110) thereby unobtrusively due to the presence of a gap fabricated between the main frame (100) and the side frame (110).

Referring again to FIG. 12, when the concrete beam is subjected to a casting by the side frame, at the second end of the mounting bracket (160), the fastener would stay at the outer end (515*b*) of the second elongated aperture (515). With reference to FIGS. 13*a* and 13*b*, the main frame (100) is shown gradually lowered, the mounting bracket is tilted slantingly which the fastener would correspondingly slide down along the second elongated aperture (515) towards its inner end (515*a*). The continued lowering of the main frame (100) would cause the fastener to be kept biased to the inner end (515*a*), as a consequence, hauling the side frame (110) by the mounting bracket (160). Subsequently, as mentioned in the foregoing description, the side frame (110) would be continuously pulled and detached from the concrete beam.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the scope of the invention.

The invention claimed is:

1. A formwork system for constructing a structural concrete floor comprising:

an adjustable main frame (100) forming a concrete slab formwork structure;

a plurality of adjustable side frames (110) each movably mounted at the edge of the main frame (100), each side frame forming a concrete beam formwork structure;

a plurality of retainers mounted at the edge of the main frame for supporting below the side frames;

jacking means for raising and lowering the formwork system;

wherein the main frame is provided with a concrete ceiling slab formwork surface; each side frame (110) forms the side of a respective concrete beam extended from the concrete ceiling slab; the side frames (110) being movable enable the formwork system to be effectively detached from a casted structural concrete floor having concrete beams extended therefrom; and the formwork system is extricable on site after fabrication of the concrete ceiling slab floor and beams;

characterized in that the retainers are cantilever brackets (55) each comprising:

a side truss (165) detachably mounted to a main prop (30) of the main frame (100);

an upper horizontal member (170) at one end attached to the top portion of the side truss (165);

a lower horizontal member (180) at one end attached to the side truss (165) for supporting a respective bottom of a respective side frame;

a vertical bracing (185) having its upper end attached to the upper horizontal member (170) and the lower end attached to the lower horizontal member (180);

a side inclined bracing (190) having one end attached to the lower horizontal member (180) and an opposite other end attached to the bottom portion of the side truss (165);

a leveling jack (195) positioned at the end of a formed lower horizontal primary member for supporting a sheathing (5) for forming the bottom of the concrete beam at an adjustable position; and a plurality of horizontal beams (200) transversely disposed at the top of the lower horizontal members (180) thereof wherein the horizontal beams (200) each comprising:

a plurality of outer portions each having a relatively large cross sectional area; and a plurality of inner portions each having a relatively small cross sectional area telescopically received in the outer portion for selective length adjustment of the horizontal beam;

wherein the outer portions are slidable along the inner portions.

2. The formwork system as recited in claim 1, wherein the side frames (110) each comprising:

a plurality of sheathings (5) disposed at the top and the side of the side frame;

a plurality of side beams (45) spanning across the inner side of the sheathings (5);

a plurality of side props (50) retaining the side beams (45);

a plurality of mounting brackets (160) each at one end mounted at a predetermined position to the upper portion of the side prop (50), the other end of the mounting bracket (160) is pivotally mounted to the main frame (100) for enabling the side frame (110) to be tiltable on a horizontal axis relative to the main frame (100); and an inner beam (400) extending at the inner side of the side props (50) substantially in a relatively transverse manner below the mounting brackets (160).

3. The formwork system as recited in claim 2, wherein the side beams (45) each comprising:

a plurality of outer portions each having a relatively large cross sectional area; and a plurality of inner portions each having a relatively small cross sectional area telescopically received in the respective outer portions for selective length adjustment of the side beams;

wherein the outer portions are slidable along the inner portions; and the side frame (110) is facilitated to have an longitudinally extensible surface according to said selective length adjustment.

4. The formwork system as recited in claim 2, wherein the main frame (100) comprising:

a plurality of main props (30);

a plurality of sheathings (5) mounted on top of the main props (30);

a plurality of upper primary beams (15) mounted to the main props (30);

a plurality of upper secondary beams (10) mounted to the main props (30), the upper secondary beams (10) are disposed on top of the upper primary beams (15), and the upper secondary beams (10) spanning below the sheathings (5); and a plurality of supporting brackets (80) each mounted to the main props (30) for propping the upper primary and secondary beams (15 & 10);

wherein the upper secondary beams (10) are disposed in a substantially transverse manner relative to the upper primary beams (15).

5. The formwork portion as recited in claim 4, wherein the mounting brackets (160) each comprising:

an elongated aperture (515) formed at the inner end thereof for securing means to pivotally secure the mounting bracket (160) to the corresponding upper primary beam of the main frame (100); and an aperture formed at the outer end thereof for securing means to fix the mounting bracket (160) to the side prop (50) of the side frame (110).

6. The formwork system as recited in claim 4, wherein the upper primary beams (15) each comprising:

a plurality of outer portions (302*b*) each having a relatively large cross sectional area; and a plurality of inner portions (304*b*) each having a relatively small cross sectional area telescopically received in the outer portions (302*b*) for selective length adjustment of the upper primary beam (15);

wherein the outer portions (302*b*) are slidable along the inner portions (304*b*); and the main frame (100) is adjustably extensible according to said selective length adjustment.

7. The formwork recited as recited in claim 4, wherein the upper secondary beams (10) each further comprising:

a plurality of outer portions (302*a*) each having a relatively large cross sectional area; and a plurality of inner portions (304*a*) each having a relatively small cross sectional area telescopically received in the outer portions (302*a*) for selective length adjustment of the upper secondary beam (10);

wherein the outer portions (302*a*) are slidable along the inner portions (304*a*); and the main frame (100) is adjustably extensible according to said selective length adjustment.

8. The formwork system as recited in claim 4, wherein the main frame (100) further comprising a plurality of legs (32) each mounted to the corresponding main prop (30) of the main frame (100).

9. The formwork system as recited in claim 1 further comprising an end side frame (140) having:

a plurality of sheathings (5);

a plurality of outer side beams (210) spanning across the inner side of the sheathings (5);

a plurality of outer side props (215) retaining the outer side beams (210); and a plurality of outer inclined bracings (220) at the upper end mounted to the top portion of the outer side props (215).

10. The formwork system as recited in claim 9, wherein the outer side beams (210) each comprising:

a plurality of outer portions each having a relatively large cross sectional area; and a plurality of inner portions each having a relatively small cross sectional area telescopically received in the outer portions for selective length adjustment of the side beam;

wherein the outer portions are slidable along the inner portions; and the outer side frame is facilitated to have an longitudinally extensible surface according to said selective length adjustment.

11. The formwork system as recited in claim 1 further comprising a cantilever portion (150) comprising:

a plurality of inner side trusses (225) each adjustably mounted to the main prop (30) of the main frame (100);

a plurality of outer side truss (230) each having a horizontal bracing (240) at lower portion thereof connected to the inner side truss (225);

a plurality of horizontal shafts (245) each propped at the top ends of the inner side truss (225) and the outer side truss (230);

a plurality of diagonal beams (250) each attached to the lower portion of the outer side truss (230) and the outer end of the horizontal shaft (245);

a longitudinal beam (255) mounted transversely on the horizontal shafts (245) to retain the side frame;

a plurality of retaining beams (510) mounted transversely on the horizontal shafts (245) and positioned between the side frame (110) and the end side frame (140); and a longitudinal sheathing mounted on the retaining beams (510);

wherein the outer inclined bracings (220) each at the lower end are coupled substantially to the outer end of the corresponding horizontal shaft (245).

12. The formwork system as recited in claim 11, wherein the longitudinal beams (255) each comprising:

a plurality of outer portions each having a relatively large cross sectional area; and a plurality of inner portions each having a relatively small cross sectional area telescopically received in the outer portions for selective length adjustment of the longitudinal beam (255);

wherein the outer portions are slidable along the inner portions; and the cantilever portion (150) is facilitated to have an adjustably extensible length according to said selective length adjustment.

13. The formwork system as recited in claim 11, wherein the retaining beams (510) each further comprising:

a plurality of outer portions each having a relatively large cross sectional area; and a plurality of inner portions each having a relatively small cross sectional area telescopically received in the outer portions for selective length adjustment of the retaining beam;

wherein the outer portions are slidable along the inner portions.

14. The formwork system as recited in claim 4 further comprising:

a plurality of lower primary beams (25) mounted to the main props (30);

a plurality of lower secondary beams (20) mounted to the main props (30); the lower secondary beams (20) are disposed on top of the lower primary beams (25), (20);

a plurality of vertical bracings each at the top end mounted to the upper primary beam (15) and at the bottom end mounted to the lower primary beam (25); and a plurality of inclined bracings each mounted to the corresponding lower primary beam (25) and the corresponding main prop (30);

wherein the lower secondary beams (20) are substantially disposed in a transverse manner relative to the lower primary beams (25).

15. The formwork system as recited in claim 14, wherein the lower primary beams (25) each comprising:

a plurality of outer portions each having a relatively large cross sectional area; and a plurality of inner portions each having a relatively small cross sectional area telescopically received in the outer portions for selective length adjustment of the upper primary beam (25);

wherein the outer portions are slidable along the inner portions; and the main frame (100) is adjustably extensible according to said selective length adjustment.

16. The formwork system as recited in claim 14, wherein the lower secondary beams (20) each further comprising:

a plurality of outer portions each having a relatively large cross sectional area and a plurality of inner portions each having a relatively small cross sectional area telescopically received in the outer portions for selective length adjustment of the lower secondary beam;

wherein the outer portion is slidable along the inner portion; and the main frame (100) is adjustably extensible according to said selective length adjustment.

17. The formwork system as recited in claim 2, wherein the inner beam (400) comprising:

a plurality of outer portions each having a relatively large cross sectional area; and a plurality of inner portions each having a relatively small cross sectional area telescopically received in the outer portions for selective length adjustment of the side beam;

wherein the outer portion is slidable along the inner portion; and the side frames (110) is facilitated to have an longitudinally extensible surface according to said selective length adjustment.

18. The formwork system as recited in claim 8, wherein the plurality of legs (30) each at the bottom portion thereof are attached with base support which includes jacking means (260).

19. The formwork system as recited in claim 8, further comprising a plurality of wheels (265) attached at the bottom of the legs (32) for transportation purpose.

* * * * *